US010403102B2

(12) United States Patent
Day

(10) Patent No.: US 10,403,102 B2
(45) Date of Patent: Sep. 3, 2019

(54) SENSOR FOR BARRIER

(71) Applicant: Vivint, Inc., Provo, UT (US)

(72) Inventor: Wallace E. Day, Provo, UT (US)

(73) Assignee: Vivint, Inc., Provo, UT (US)

( * ) Notice: Subject to any disclaimer, the term of this patent is extended or adjusted under 35 U.S.C. 154(b) by 0 days.

(21) Appl. No.: 15/432,186

(22) Filed: Feb. 14, 2017

(65) Prior Publication Data

US 2018/0233005 A1 Aug. 16, 2018

(51) Int. Cl.
*G08B 13/08* (2006.01)
*G08C 17/02* (2006.01)

(52) U.S. Cl.
CPC ..... *G08B 13/08* (2013.01); *G08C 17/02* (2013.01); *G08C 2201/50* (2013.01)

(58) Field of Classification Search
CPC ..... E05D 11/00; E05D 15/00; E05D 7/00; E05Y 2900/132; E05Y 2400/354; E05Y 2400/51; E05Y 2201/46; E05Y 2400/32; E05Y 2400/324; E05Y 2400/326; E05Y 2400/44; E05Y 2400/502; E05Y 2400/508
See application file for complete search history.

(56) References Cited

U.S. PATENT DOCUMENTS 3,803,576 A * 4/1974 Dobrzanski ..... G08B 13/08 340/528
6,577,235 B2 6/2003 Frys
7,610,684 B2 11/2009 Steinich
9,366,065 B2 6/2016 Ricks et al.
2002/0067259 A1* 6/2002 Fufidio ..... G07C 9/00031 340/541
2010/0182001 A1* 7/2010 Furukawa ..... B65G 43/02 324/241
2015/0086958 A1* 3/2015 Lewis ..... G09B 23/288 434/267
2016/0300415 A1* 10/2016 Deneen ..... E05F 15/668
2017/0205250 A1* 7/2017 Aichriedler ..... G01R 21/08

FOREIGN PATENT DOCUMENTS

JP 2015125918 A 7/2015
WO 2016109889 A1 7/2016

* cited by examiner

*Primary Examiner* — Omeed Alizada
(74) *Attorney, Agent, or Firm* — Holland & Hart LLP

(57) ABSTRACT

Methods and systems are described for determining operation of an openable barrier into a building. A method for determining a state of a barrier includes identifying, based at least in part on a barrier sensor, a first position of the barrier. In one embodiment, the barrier sensor may be positioned at a first side of the barrier, and a magnet may be positioned adjacent to the barrier sensor at the first side of the barrier. The magnet may be positioned at an angle with respect to the barrier sensor. The method may further include determining, based at least in part on the barrier sensor and the magnet, when the barrier changes position from the first position to a second position; and wirelessly transmitting data concerning the change in position of the barrier.

16 Claims, 8 Drawing Sheets

SENSOR FOR BARRIER

BACKGROUND

Advancements in media delivery systems and media-related technologies continue to increase at a rapid pace. Increasing demand for media has influenced the advances made to media-related technologies. Computer systems have increasingly become an integral part of the media-related technologies. Computer systems may be used to carry out several media-related functions. The wide-spread access to media has been accelerated by the increased use of computer networks, including the Internet and cloud networking.

Many homes and businesses use one or more computer networks to generate, deliver, and receive data and information between the various computers connected to computer networks. Users of computer technologies continue to demand increased access to information and an increase in the efficiency of these technologies. Improving the efficiency of computer technologies is desirable to those who use and rely on computers.

With the wide-spread use of computers and mobile devices has come an increased presence of home/business automation and security products. Advancements in mobile devices allow users to monitor and/or control an aspect of a home or business. As automation and security products expand to encompass other systems and functionality in the home and/or businesses, opportunities exist for more accurately monitoring a property and providing functionality in response.

SUMMARY

Methods and systems are described for determining operation of an openable barrier into a building. According to at least one embodiment, a method for determining a state of a barrier includes identifying, based at least in part on a barrier sensor, a first position of the barrier. The barrier sensor may be positioned at a first side of the barrier, and a magnet may be positioned adjacent to the barrier sensor at the first side of the barrier. The magnet may be positioned at an angle with respect to the barrier sensor. The method may further include determining, based at least in part on the barrier sensor and the magnet, when the barrier changes from the first position to a second position; and wirelessly transmitting data concerning the change in position of the barrier.

In one example, the first side of the barrier may include at least one hinge. In one example, the barrier sensor may be mounted on a barrier frame adjacent to the first side of the barrier and the magnet may be mounted on the first side of the barrier. In another example, the magnet may be mounted on a barrier frame adjacent to the first side of the barrier and the barrier sensor may be mounted on the first side of the barrier.

In one example, the method may further include determining movement of the barrier with a motion sensor. The method may include determining with the motion sensor when an object moves through an opening that is controlled by the barrier. The first position may be a closed position, and the second position may be an open position. The first position may be a first open position, and the second position may be a second open position. The method may include determining at least one of the first and second positions.

In one example, the angle at which the magnet is positioned may be adjustable to alter a sensitivity of the barrier sensor.

Another embodiment is directed to a sensor assembly for use with a barrier. The sensor assembly may include a barrier sensor positioned at a first side of the barrier, and a magnet positioned adjacent to the barrier sensor at the first side of the barrier. The magnet may be positioned at an angle with respect to the barrier sensor. The sensor assembly may be operable to determine when the barrier changes position from a first position to a second position.

A further embodiment is directed to a barrier position detecting apparatus. The apparatus may include a barrier sensor positioned at a first side of the barrier, and a magnet positioned adjacent to the barrier sensor at the first side of the barrier. The magnet may be positioned at an angle with respect to the barrier sensor. The apparatus may further include a transmitter configured to wirelessly transfer data when the barrier changes position from a first position to a second position, based at least in part on the barrier sensor and the magnet.

The foregoing has outlined rather broadly the features and technical advantages of examples according to the disclosure in order that the detailed description that follows may be better understood. Additional features and advantages will be described hereinafter. The conception and specific examples disclosed may be readily utilized as a basis for modifying or designing other structures for carrying out the same purposes of the present disclosure. Such equivalent constructions do not depart from the spirit and scope of the appended claims. Features which are believed to be characteristic of the concepts disclosed herein, both as to their organization and method of operation, together with associated advantages will be better understood from the following description when considered in connection with the accompanying figures. Each of the figures is provided for the purpose of illustration and description only, and not as a definition of the limits of the claims.

BRIEF DESCRIPTION OF THE DRAWINGS

A further understanding of the nature and advantages of the embodiments may be realized by reference to the following drawings. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

Figure 1:
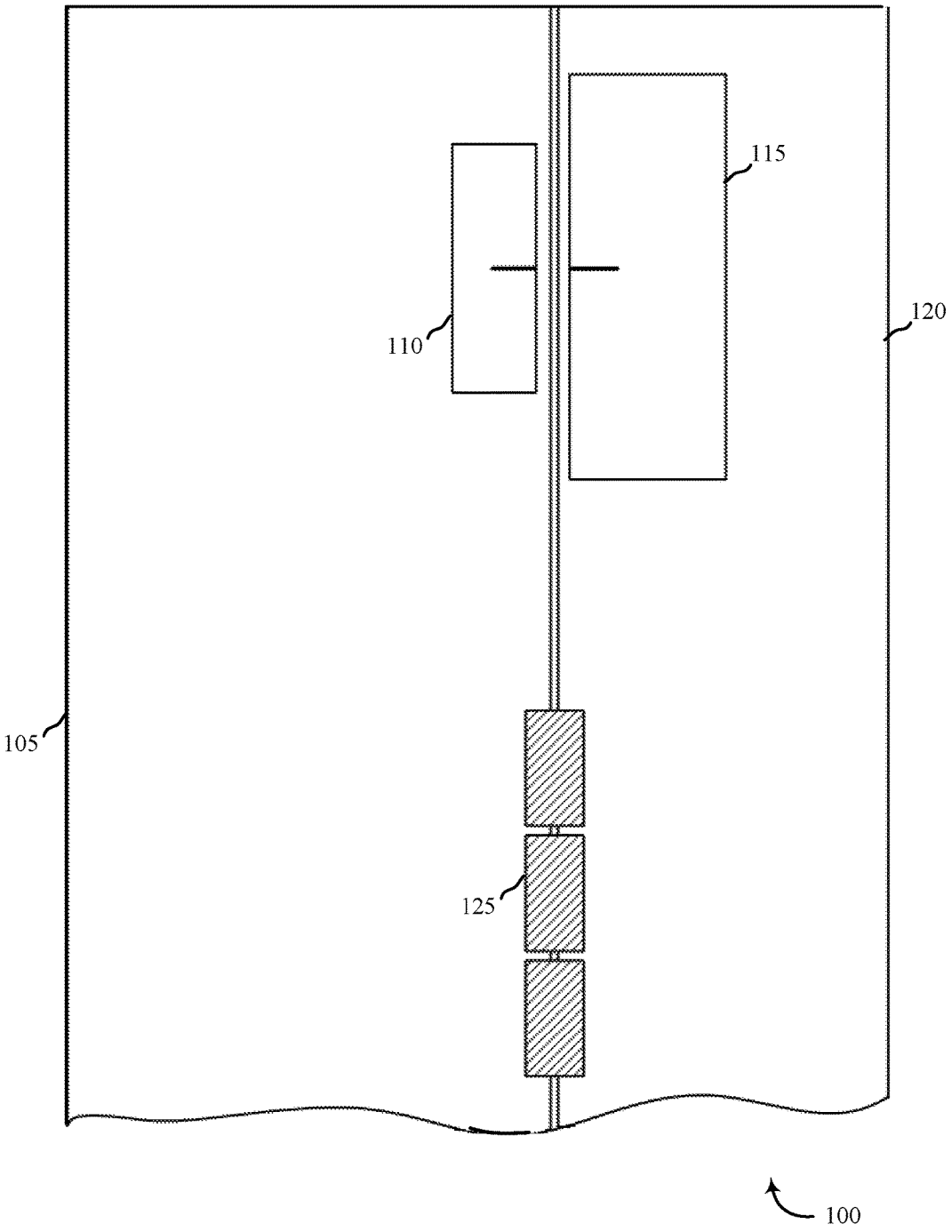
FIG. 1 is front view of a barrier assembly having a barrier and a barrier sensor assembly in which the systems and methods disclosed herein may be implemented.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION

The systems and methods described herein relate to home automation and home security, and related security systems and automation for use in commercial and business settings. As used herein, the phrase "home automation system" may refer to a system that includes automation features alone, security features alone, a combination of automation and security features, or a combination of automation, security and other features. While the phrase "home automation system" is used throughout to describe a system or components of a system or environment in which aspects of the present disclosure are described, such an automation system and its related features (whether automation and/or security features) may be generally applicable to other properties such as businesses and commercial properties as well as systems that are used in indoor and outdoor settings.

The systems and methods described herein relate generally to monitoring operation and/or movement of a barrier, such as a door or window. Among other functions, home automation systems typically monitor and control access through barriers such as doors and windows. There are a number of challenges related to determining if operation of or entry through a barrier is authorized. Data related to operation of a barrier may be used for a variety of purposes. For example, determining whether operation of or entry through a barrier is authorized may influence whether 1) an alarm is avoided when an authorized person operates or passes through a barrier, or 2) an alarm is properly generated when an unauthorized person operates or passes through the barrier.

One aspect of the present disclosure relates to systems, methods and related devices for determining whether a door, window or other barrier is operated, such as when a person enters or exists a building. One or more sensors may be used to determine such access. For example, one or more sensors may be positioned at a first side of the barrier. The sensors may determine movement of the barrier (e.g., movement from a closed position to an open position, or movement from one open position to another open position). The sensors may include, for example, a potentiometer, an electrostatic sensor, a piezoelectric sensor, or a magnetic sensor.

Additionally, another sensor, such as a motion sensor, may be used to confirm that the barrier is moved and/or that an object, such as a person, has moved through the opening (e.g., doorway) associated with the barrier. The additional sensor may be positioned at a location spaced apart from the original barrier sensor (e.g., at location remote from the sensor but within a room to which the barrier provides access). Additionally, or alternatively, the additional sensor is carried in the same housing as the original barrier sensor. The additional sensor may be a different type of sensor than the type of sensor used for the original barrier sensor.

Additionally, a magnet may be positioned adjacent to the barrier sensor at the first side of the barrier. The interaction between the magnet and the barrier sensor may be used to determine the position of the barrier. The barrier sensor may include a transmitter and/or a transceiver that wirelessly communicates with a monitoring system, such as a home automation system.

The ability to determine whether the barrier is open or closed and/or whether a person or object passes through a barrier may be one of many factors used to determine use of a building (whether authorized or unauthorized) and/or a pattern of behavior for at least some users of the building. The opening and/or closing function may be associated with a particular person. For example, a person may carry a device that identifies who he/she is (e.g., authentication), and associates the barrier opening with that person. The device may be a cell phone, fob, or other device that is programmable with user identification information. Information about the barrier opening event may be communicated to a home automation system for use in determining patterns of behavior, as well as in predicting activities associated with the building that may occur in the future. Further, information about the barrier opening may be used to control, for example, whether a handle of the barrier remains locked or is automatically unlocked. The automated control of the barrier may be overridden based on various factors such as, for example, the person operating the barrier, the time of day, or the type of barrier.

FIG. 1 shows a door assembly 100 having a door 105 and a door frame 120, where the door 105 and door frame 120 are coupled by at least one hinge 125. In the illustrated example, door 105 is closed. A magnet 110 may be mounted to the door 105, and a sensor 115 may be mounted to the door frame 120. Although illustrated in this example as a door assembly 100, in other embodiments assembly 100 may include a window assembly or any other barrier. Additionally, although illustrated in this example having the magnet 110 mounted on the door 105, and the sensor 115 mounted on the door frame 120, in other embodiments the magnet 110 may instead be mounted on the door frame 120, and the sensor 115 may be mounted on the door 105. Further, although illustrated in this example having a hinge 125, in other embodiments the barrier 105 may be coupled to the barrier frame 120 by any known means to allow for rotation, sliding, or other movement between the barrier 105 and the barrier frame 120.

Sensor 115 may include a hollow interior (not shown) configured to house at least one power supply such as a battery. Sensor 115 may also be configured to house other components such as, for example, a sensor, a transceiver, a magnet, a processor, memory, or the like.

Typically, barrier sensors are positioned on the handle side of a door, window, or other barrier, such that movement of the barrier may be monitored at the side of the barrier that is opened. However, such positioning may not be feasible for all barrier configurations. Accordingly, the present disclosure allows for placement of the sensor 115 at a side of the door 105 opposite to the side having a handle; in this case, on the side of the door 105 having a hinge 125. In order to detect movement of the barrier, the magnet 110 must be sufficiently sensitive to detect a smaller range of motion with the sensor 115 than is needed when the sensor is positioned on the handle side of the door. This sensitivity is achieved by adjusting the angle at which the magnet 110 is positioned with respect to the sensor 115, as described in more detail below.

Figure 2:
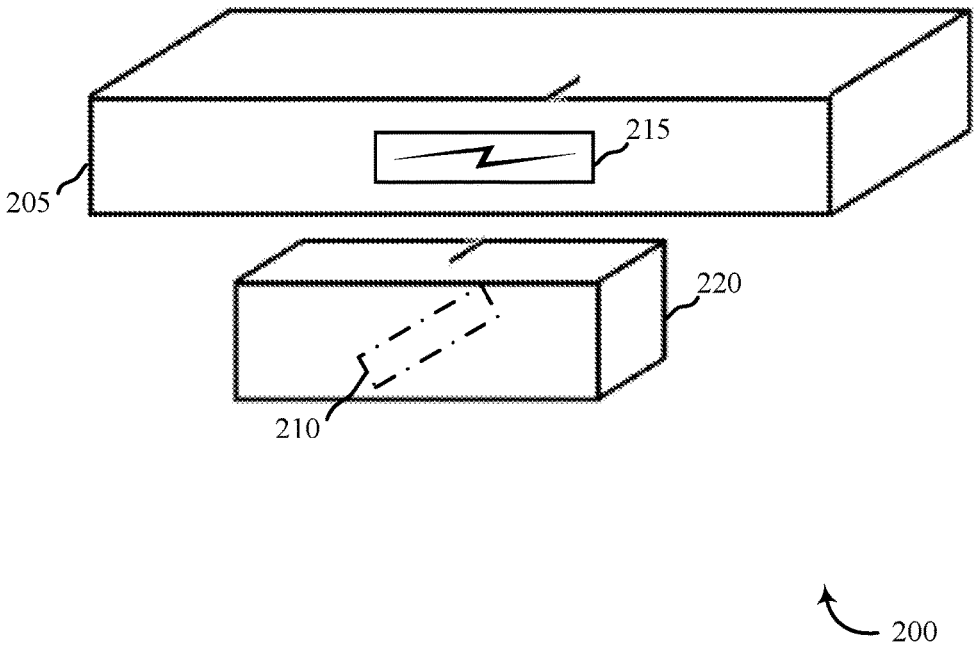
FIG. 2 is a perspective view of the barrier assembly shown in FIG. 1 with the barrier in an open position.

Sensor 115 may have any desired shape and size. In one example, sensor 115 has a generally rectangular shape, as shown in FIGS. 1 and 2. Sensor 115 may include a mounting structure arranged for coupling with door 105 or door frame 120. Data from sensor 115 may be translated wirelessly to a remotely located controller. The controller may be part of, for example, a home automation system.

FIG. 2 illustrates a perspective view of sensor assembly 200, including sensor housing 205 and magnet housing 220. Sensor 215, which may be an example of sensor 115 as illustrated in FIG. 1, may be positioned inside sensor housing 205. Magnet 210, which may be an example of magnet 110 as illustrate in FIG. 1, may be positioned inside magnet housing 220. As illustrated in FIG. 2, magnet 210 may be positioned at an angle with respect to sensor 215, in order to increase the sensitivity of the sensor 215 in detecting the magnetic field put off by magnet 210. In some embodiments, magnet housing 220 may be positioned on a door or other barrier, and sensor housing 205 may be positioned on a door frame or other barrier frame. In other embodiments, sensor housing 205 may be positioned on the door or other barrier, and magnet housing 220 may be positioned on the door frame or other barrier frame.

Sensor 215 may be operable to detect movement of the door or other barrier through use of a reed switch. The reed switch may include a pair of magnetizable, flexible, metal reeds. The end portions of the two reeds may be separated by a small gap when the reed switch is open. When the door is closed, the magnet 210 may be aligned with the sensor 215. The magnetic field from magnet 210 may cause the two reeds to come together, thus completing an electrical circuit. When the door is opened, the two reeds may separate, opening the electrical circuit.

As the door is moved from a closed position to an open position, sensor 215 may move out of the magnetic field created by magnet 210. Sensor 215 may determine a distance of separation from magnet 310, which may be converted into information related to a position of the door relative to the door frame (i.e., an open or closed position, or a rotated position of the door in any of an infinite number of open positions).

Figure 3A:
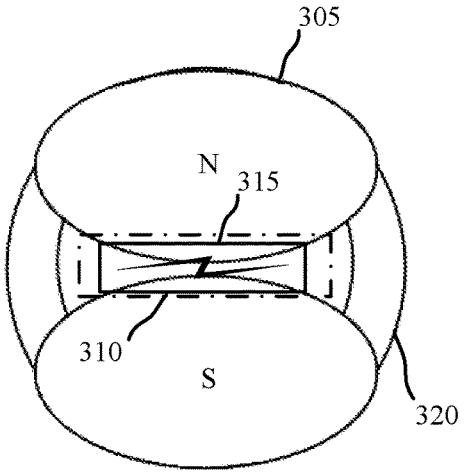
FIG. 3*a* is a side view of the barrier sensor assembly shown in FIG. 1.
Figure 3B:
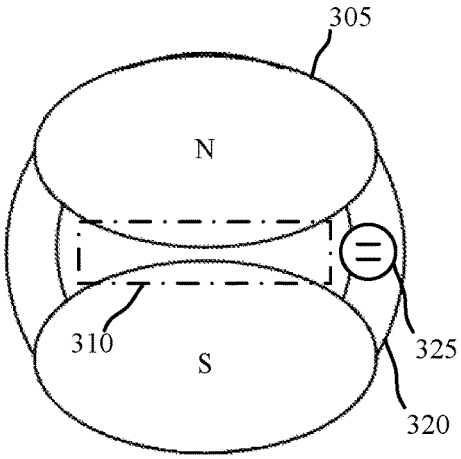
FIG. 3*b* is an end view of the barrier sensor assembly shown in FIG. 1.
Figure 3C:
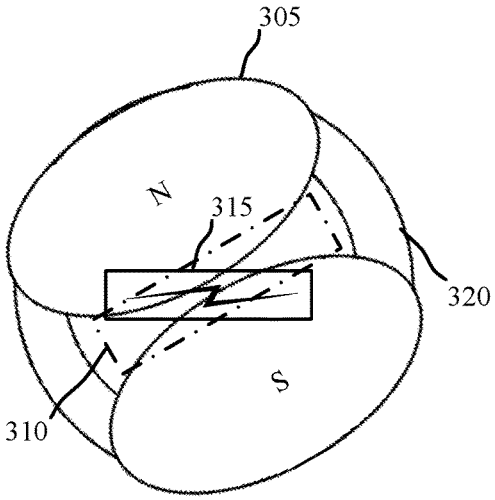
FIG. 3*c* is an alternate side view of the barrier sensor assembly shown in FIG. 1.

FIGS. 3*a*-3*c* illustrate the interaction between the magnet and the sensor. FIG. 3*a* is a side view, showing magnet 310 and sensor 315, which may be examples of magnet 110, 210 and sensor 115, 215, respectively, as illustrated in FIGS. 1 and 2. Magnet 310 may produce a magnetic field having north (N) and south (S) poles. The magnetic field produced by magnet 310 may be strongest around the poles 305, but may be weakest in the space between the poles 320. In the example illustrated in FIG. 3*a*, sensor 315 may be aligned with magnet 310. FIG. 3*b* is an end view of the same sensor and magnet configuration illustrated in FIG. 3*a*. As shown from this end view, when sensor 315 is aligned with magnet 310, reed switch 325 may be positioned within the weak magnetic field created between the poles 320. Such positioning may limit the ability of sensor 315 to detect movement of the barrier as a result of a change in the magnetic field. In FIG. 3*c*, magnet 310 is instead rotated to be positioned at an angle with respect to sensor 315. By angling magnet 310, sensor 315 is positioned within the strongest portion of the magnetic field 305 produced by magnet 310, rather than being positioned within the weakest portion of the magnetic field 320. By extension, reed switch 325 is positioned within the strongest portion of the magnetic field 305 produced by magnet 310, and sensor 315 may accordingly detect movement of the barrier with greater sensitivity.

The embodiments shown in FIGS. 1-3 are directed to sensor assemblies that are used with doors. Doors are just one type of barrier used to control access to an opening of a building or other structure. The sensor assemblies disclosed herein may be used with other types of barriers such as windows.

The barrier sensors and barrier sensor assemblies disclosed herein may be used in combination with other features of a barrier. For example, a drive mechanism may be mounted to a barrier to apply a force that opens or closes the barrier. The operation of the drive may be controlled at least in part based on feedback from the barrier sensor. For example, the barrier sensor may indicate that the barrier is arranged at a 45° open position relative to a closed position. Alternatively, the open position of the door may be defined as a percentage (e.g., 25% open) or a distance (e.g., 18 inches open). A user may provide input for opening the door to a position of 90°, which may be carried out by operating the drive to further open the door. In another example, the barrier sensor may indicate that the barrier is in any open position. The drive may be operated to close the barrier based on, for example, a time of day, a weather condition, or some other parameter measured automatically by a home automation system or controlled manually by a user. The barrier may be confirmed closed by further feedback from the barrier sensor, a motion sensor, or other feature of the home automation system.

Figure 4:
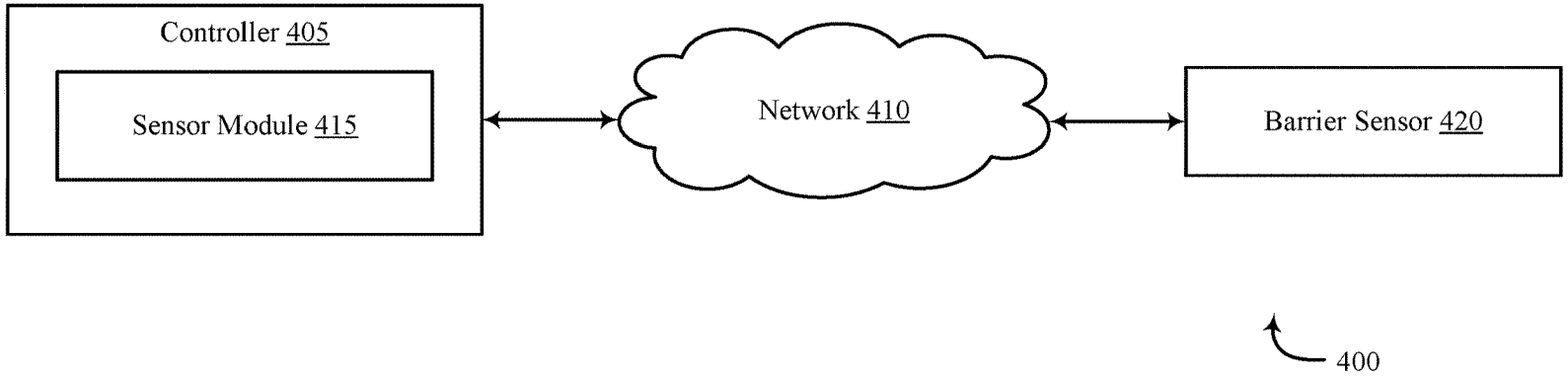
FIG. 4 is a block diagram of an environment in which the present systems and methods may be implemented.

FIG. 4 is a block diagram illustrating one embodiment of an environment 400 in which the present systems and methods may be implemented. In some embodiments, the systems and methods described herein may be performed on or using a barrier sensor 420 that communicates with a controller 405 via a network 410. Controller 405 includes a sensor module 415. Barrier sensor 420 may generate and transmit information concerning an open state and/or position of a barrier such as a door or window with which the barrier sensor 420 is operated. The sensor signals and/or other information generated by barrier sensor 420 may be transmitted over network 410 to controller 405. Sensor module 415 may determine, at least in part using the information received from barrier sensor 420, an operation state and/or position of the barrier. The network 410 provides communication via, for example, a wired or wireless connection.

Barrier sensor 420 may include one or more sensors and operate to determine at least one operational parameter or characteristic of a barrier (e.g., as described above with reference to FIGS. 1-3). For example, barrier sensor 420 may determine whether a barrier (e.g., a door or window of a building) is in a closed state or in an open state. In another example, barrier sensor 420 may indicate an open position of a barrier or a change in position of an open barrier (e.g., a change between a 30° rotated position and a 90° rotated position when a closed position is at 0°).

In examples where barrier sensor 420 includes a plurality of different sensors, one sensor may provide one set of information related to the barrier (e.g., an open or closed state of the barrier) and another sensor may indicate a rotated or other open position of the barrier relative to the closed position. The combination of information provided by the various sensors may be utilized by the sensor module 415 to determine an operation state or position of the barrier. In another example, an additional sensor may determine motion of the barrier itself or other objects that pass through or are in close proximity to the opening controlled by the barrier. For example, a motion sensor may be part of or associated with barrier sensor 420. The various sensors and functionality of barrier sensor 420 may help determine from which side a barrier is opened (e.g., on an interior side or an exterior side of the barrier), or whether an object has passed through the opening whose access is controlled by the barrier. Information related to which side of a barrier the barrier is being operated and/or whether an object passes through the opening controlled by the barrier may be helpful in deducing other types of information, patterns, occupant locations, etc., that may be used to provide other features and functionality related to, for example, the barrier itself and/or a home automation system within which the controller 405, network 410, and barrier sensor 420 operate.

In some examples, environment 400 represents at least a portion of a home automation system. The controller 405 may be part of, for example, a control panel of the home automation system. The barrier sensor 420 may be associated with a barrier that provides an access point into a home (e.g., a door or window). Network 410 may include or be part of a wireless network, a wired network, or some combination thereof.

Figure 5:
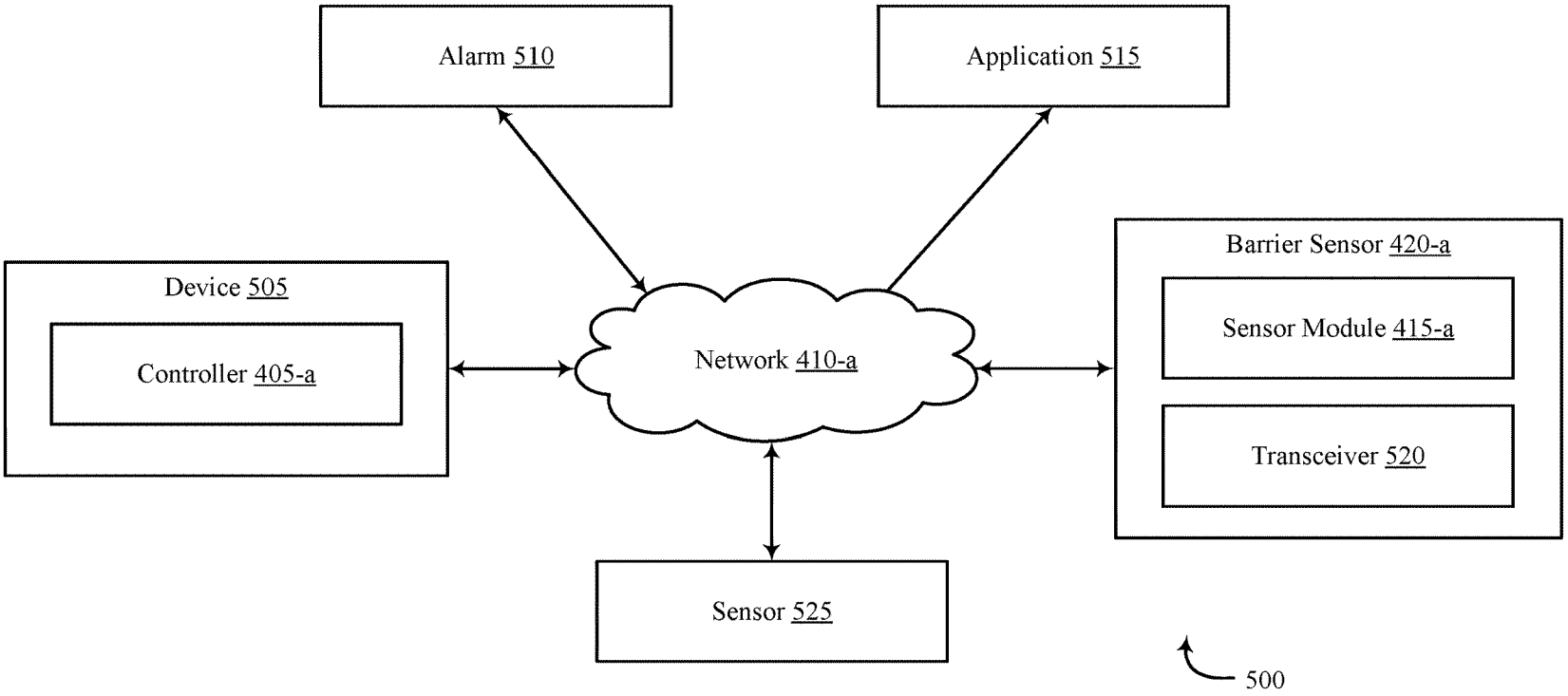
FIG. 5 is a block diagram of an environment in which the present systems and methods may be implemented.

Referring now to FIG. 5, in some embodiments, an environment 500 may include the components of environment 400 described above, and may further include the sensor module 415-*a* as part of a barrier sensor 420-*a*. Environment 500 may also include a device 505 to which the controller 405-*a* belongs. In some examples, device 505 includes, for example, a control panel of a home automation system, a back end server or a central station of the home automation system. Environment 500 may also include an alarm 510, an application 515, and a sensor 525. Barrier sensor 420-*a* may additionally include transceiver 520.

Device 505 may include, for example, a control panel of the home automation system. Alternatively, device 505 may be a portable electronic device including, for example, a touch screen display. Device 505 may be in communication with one or more sensors such as barrier sensor 420-*a* via network 410-*a*. Additionally, or alternatively, device 505 may be in communication with other types of sensors such as, for example, sensor 525. Device 505 may also be in communication with alarm 510 and application 515.

Controller 405-*a* may include at least some processing or logic capability and provide communication with at least some of the sensors with which device 505 communicates (e.g., barrier sensor 420-*a*).

Alarm 510 may provide a text message, an audible sound, lights, or the like that provide communication with one or more users on the property being monitored by a home automation system. Alarm 510 may provide communications with a remote device or system related to a condition of the property being monitored. Alarm 510 may be integrated into device 505. Alarm 510 may operate in response to data received from barrier sensor 420-*a* such as, for example, an unauthorized opening or closing of a barrier.

Application 515 may allow a user to control (either directly or via, for example, controller 405-*a*) an aspect of the monitored property, including a security, energy management, locking or unlocking of a barrier, checking the status of a barrier, locating a user or item, controlling lighting, thermostats, or cameras, receiving notifications regarding a current status or anomaly associated with a home, office, place of business, and the like. In some configurations, application 515 may enable barrier sensor 420-*a* to interface with device 505 and utilize a user interface to display automation, security, and/or energy management content on a display, user interface, mobile computing device, or other feature of environment 500 and/or device 505. Application 515, via a user interface, may allow users to control aspects of their home, office, and/or other type of property. Further, application 515 may be installed on a mobile computing device in order to allow a user to interface with functions of the components shown in environment 500 (e.g., barrier sensor 420-*a*), such as components of a home automation and/or home security system.

Sensor 525 may represent one or more separate sensors or a combination of two or more sensors in a single sensor device. For example, sensor 525 may represent one or more camera sensors and one or more motion sensors connected to environment 500. Additionally, or alternatively, sensor 525 may represent a combination sensor such as both a camera sensor and a motion sensor integrated into the same sensor device. Additionally, or alternatively, sensor 525 may be integrated into a home appliance or a fixture such as a light bulb fixture and/or the barrier sensor 420-*a*. Sensor 525 may include an accelerometer to enable sensor 525 to detect a movement. Sensor 525 may include a wireless communication device that enables sensor 525 to send and receive data and/or information to and from one or more devices in environment 500 (e.g., such as a controller 405-*a*). Additionally, or alternatively, sensor 525 may include a GPS sensor to enable sensor 525 to track a location of sensor 525. Sensor 525 may include a proximity sensor to enable sensor 525 to detect proximity of a user relative to a predetermined distance from a dwelling (e.g., a geo fence or barrier). Sensor 525 may include one or more security detection sensors such as, for example, a glass break sensor, a motion detection sensor, or both. Additionally, or alternatively, sensor 525 may include a smoke detection sensor, a carbon monoxide sensor, or both. In at least some examples, sensor 525 may detect the presence of a user within a dwelling or entryway into a home monitored by components of environment 500, performing certain functions (e.g., opening a door or window), or speaking a voice command. Sensor 525 may be integrated into or used in place of either one of barrier sensor 420-*a* and other sensors associated with the property being monitored by a home automation system of environment 500. Sensor 525 may include a motion sensor.

Network 410-*a* may include cloud networks, local area networks (LAN), wide area networks (WAN), virtual private networks (VPN), wireless networks (using 802.11, for example), and/or cellular networks (using 3G or LTE, for example), etc. In some embodiments, the network 410-*a* may include the internet.

Figure 6:
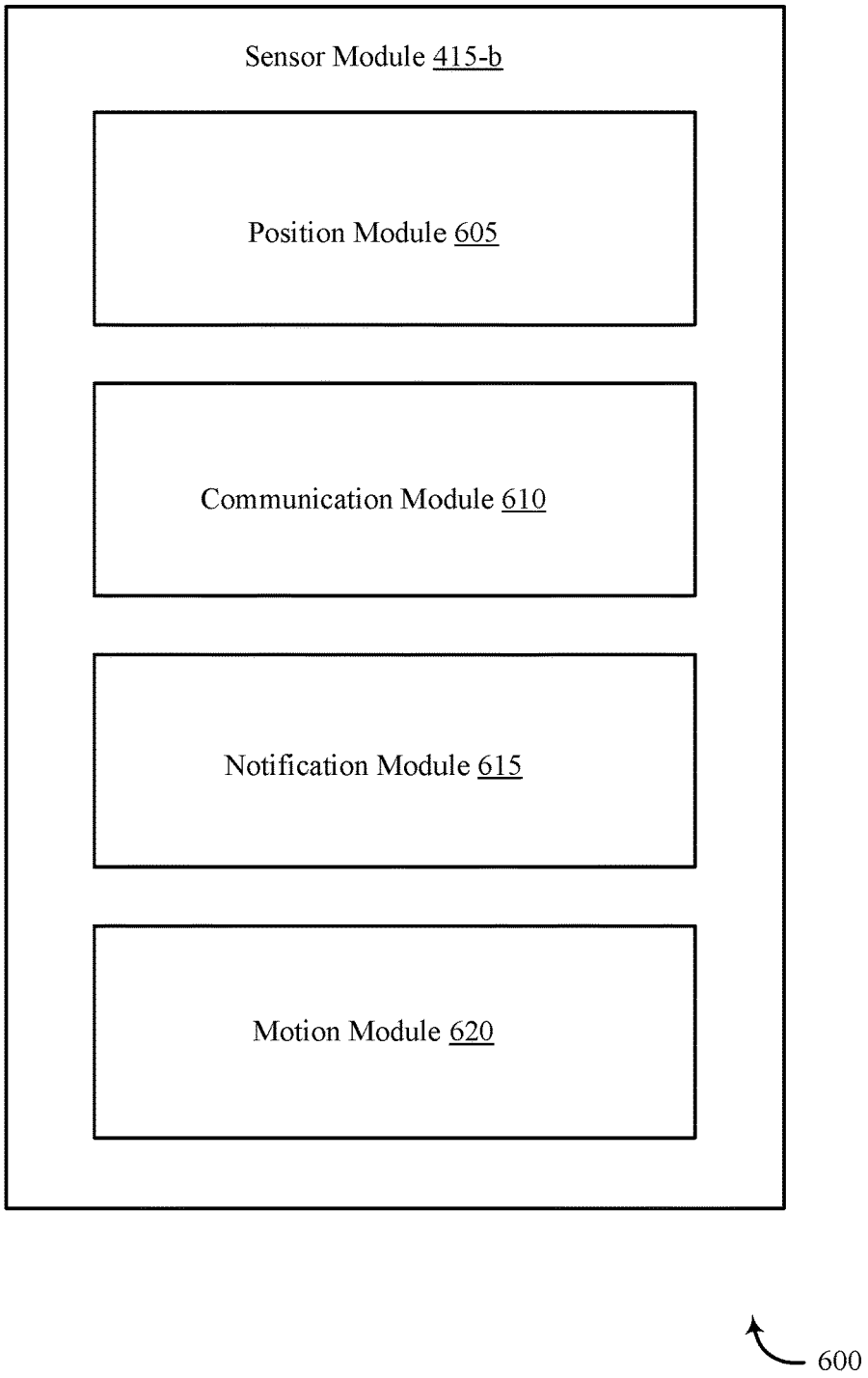
FIG. 6 is a block diagram of a barrier sensor module.

FIG. 6 is a block diagram showing a sensor module 415-*b*. Sensor module 415-*b* may be one example of the sensor module 415, 415-*a* shown in FIGS. 4 and 5. Sensor module 415-*b* may include a position module 605, a communication module 610, a notification module 615, and a motion module 620. Position module 605 may operate to receive information about a position of a barrier as received from, for example, a barrier sensor 115, 215, 315 of FIGS. 1-3 or barrier sensor 420, 420-*a* of FIGS. 4 and 5. Position module 605 may determine from data received from the barrier sensor an open or closed state of the barrier, a relative position of the barrier to a reference point (e.g., a closed state of the barrier), or a direction of change in position of the barrier, or an absolute amount of change in position of the barrier.

Communication module 610 may provide communication to and from barrier sensor 115. In at least some examples, communication module 610 may receive communications via, for example, transceiver 520 of barrier sensor 420-*a* (e.g., see description of FIG. 5). Communication module 610 may deliver data to barrier sensor 420-*a* such as, for example, instructions, software patches, and maintenance data. The information received from barrier sensor 420-*a* via communication module 610 may be provided to position module 605.

Notification module 615 may use position information provided by position module 605 and determine whether the state of the barrier or other information provided by barrier sensor 420-*a* should be communicated to another device or a user. For example, notification module 615 may send notice to alarm 510 to generate an audible, visual or other type of alarm based on an open or closed state or open position of the barrier as determined using barrier sensor 420-*a*. Notification module 615 may push notifications to a user via, for example, text messages, emails, or the like via, for example, a control panel of the home automation system, a computing device such as a desktop, laptop, notebook, or handheld computing device, or the like.

Motion module 620 may receive data from other sensors such as, for example, a motion sensor. Motion module 620 may correlate the position information provided by barrier sensor 420-*a* with motion information from the motion sensor. The notification module 615 may receive both position and motion data from position module 605 and motion module 620, respectively, as part of determining whether a notification should be generated and transmitted.

Figure 7:
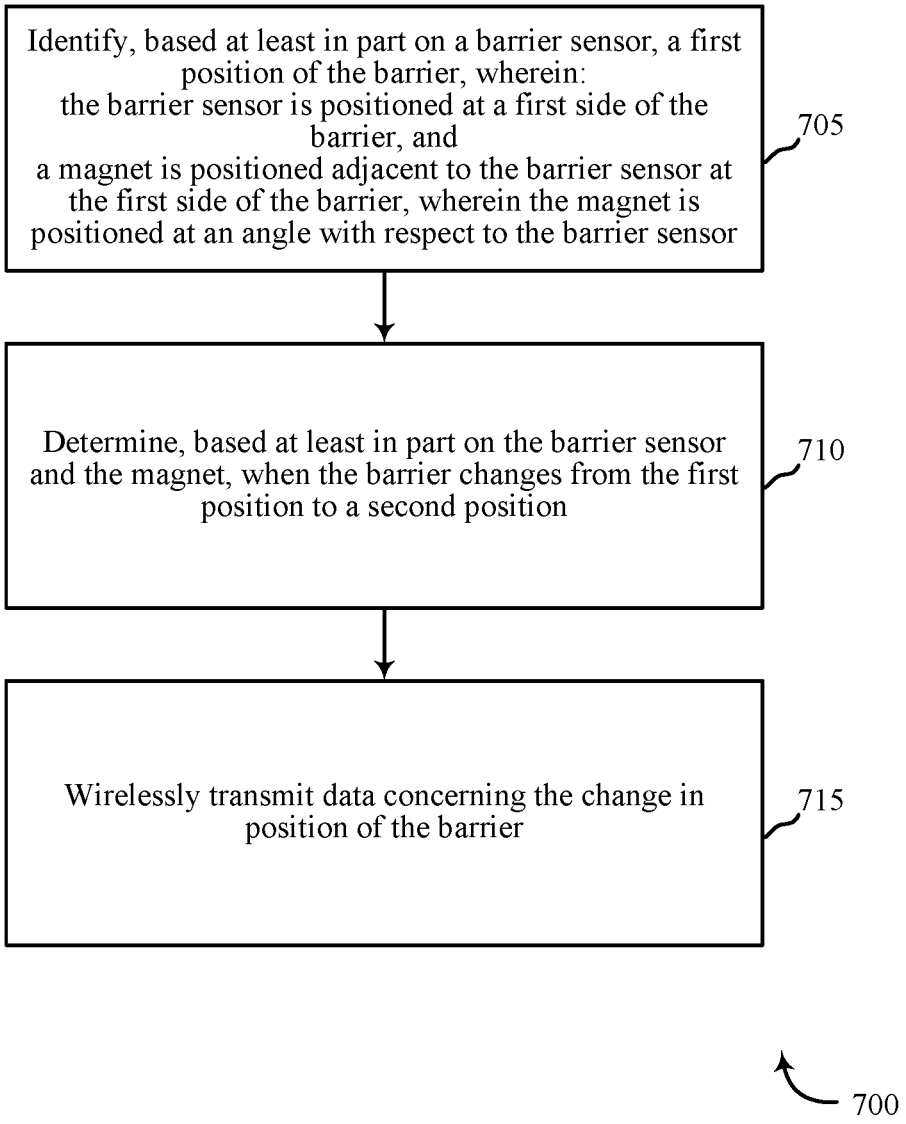
FIG. 7 is a flow diagram showing steps of an example method in accordance with the present disclosure.

FIG. 7 is a flow diagram illustrating one embodiment of a method 700 for determining a state of a barrier. In some configurations, the method 700 may be implemented by the sensor module 415, 415-*a* shown in FIGS. 4 and 5. In other examples, method 700 may be formed generally by controller 405, 405-*a* shown in FIGS. 4 and 5, barrier sensor 420, 420-*a* shown in FIGS. 4 and 5, or even more generally by the environments 400, 500 shown in FIGS. 4 and 5, respectively, or other components described with reference to FIGS. 1-6.

At block 705, the method 700 includes identifying, based at least in part on a barrier sensor, a first position of a barrier. The barrier sensor may be positioned at a first side of the barrier, and a magnet may be positioned adjacent to the barrier sensor at the first side of the barrier. The magnet may be positioned at an angle with respect to the barrier sensor. Block 710 includes determining, based at least in part on the barrier sensor and the magnet, when the barrier changes from the first position to a second position. At block 715 of method 700, the method includes wirelessly transmitting data concerning the change in barrier position.

Method 700 may also include determining movement of the barrier with a motion sensor. The motion sensor may be part of the barrier sensor. The motion sensor may determine movement of an object passing through an opening that is controlled by the barrier. The method 700 may include determining with the motion sensor when an object moves through an opening that is controlled by the barrier. The first position may be a closed position and the second position may be an open position. The first position may be a first open position and the second position may be a second open position. The method 700 may include determining at least one of the first and second positions.

Figure 8:
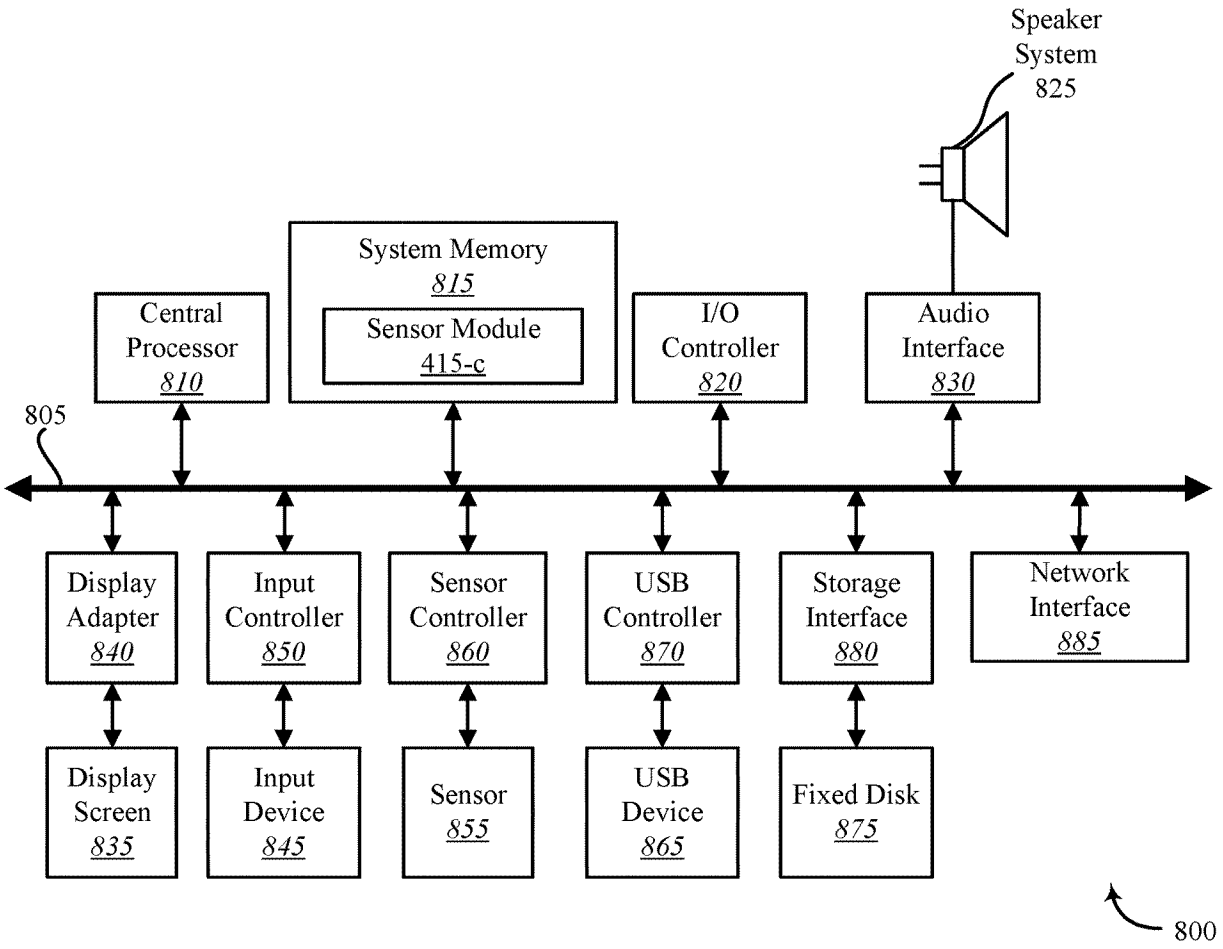
FIG. 8 is a block diagram of a computer system suitable for implementing the systems and methods of FIGS. 1-7.

FIG. 8 depicts a block diagram of a controller 800 suitable for implementing the present systems and methods. The controller 800 may be an example of the controller 405, 405-*a* illustrated in FIGS. 4 and 5. In one configuration, controller 800 includes a bus 805 which interconnects major subsystems of controller 800, such as a central processor 810, a system memory 815 (typically RAM, but which may also include ROM, flash RAM, or the like), an input/output controller 820, an external audio device, such as a speaker system 825 via an audio output interface 830, an external device, such as a display screen 835 via display adapter 840, an input device 845 (e.g., remote control device interfaced with an input controller 850), multiple USB devices 865 (interfaced with a USB controller 870), and a storage interface 880. Also included are at least one sensor 855 connected to bus 805 through a sensor controller 860 and a network interface 885 (coupled directly to bus 805).

Bus 805 allows data communication between central processor 810 and system memory 815, which may include read-only memory (ROM) or flash memory (neither shown), and random access memory (RAM) (not shown), as previously noted. The RAM is generally the main memory into which the operating system and application programs are loaded. The ROM or flash memory can contain, among other code, the Basic Input-Output system (BIOS) which controls basic hardware operation such as the interaction with peripheral components or devices. For example, a sensor module 415-*c* to implement the present systems and methods may be stored within the system memory 815. The sensor module 415-*c* may be an example of the sensor module 415, 415-*a*, 415-*b* illustrated in FIGS. 4-6. Applications (e.g., application 515) resident with controller 800 are generally stored on and accessed via a non-transitory computer readable medium, such as a hard disk drive (e.g., fixed disk 875) or other storage medium. Additionally, applications can be in the form of electronic signals modulated in accordance with the application and data communication technology when accessed via interface 885.

Storage interface 880, as with the other storage interfaces of controller 800, can connect to a standard computer readable medium for storage and/or retrieval of information, such as a fixed disk drive 875. Fixed disk drive 875 may be a part of controller 800 or may be separate and accessed through other interface systems. Network interface 885 may provide a direct connection to a remote server via a direct network link to the Internet via a POP (point of presence). Network interface 885 may provide such connection using wireless techniques, including digital cellular telephone connection, Cellular Digital Packet Data (CDPD) connection, digital satellite data connection, or the like. In some embodiments, one or more sensors (e.g., motion sensor, smoke sensor, glass break sensor, door sensor, window sensor, carbon monoxide sensor, and the like) connect to controller 800 wirelessly via network interface 885.

Many other devices or subsystems (not shown) may be connected in a similar manner (e.g., entertainment system, computing device, remote cameras, wireless key fob, wall mounted user interface device, cell radio module, battery, alarm siren, door lock, lighting system, thermostat, home appliance monitor, utility equipment monitor, and so on). Conversely, all of the devices shown in FIG. 8 need not be present to practice the present systems and methods. The devices and subsystems can be interconnected in different ways from that shown in FIG. 8. The aspect of some operations of a system such as that shown in FIG. 8 are readily known in the art and are not discussed in detail in this application. Code to implement the present disclosure can be stored in a non-transitory computer-readable medium such as one or more of system memory 815 or fixed disk 875. The operating system provided on controller 800 may be iOS®, ANDROID®, MS-dOS®, MS-WINDOWS®, OS/2®, UNIX®, LINUX®, or another known operating system.

Moreover, regarding the signals described herein, those skilled in the art will recognize that a signal can be directly transmitted from a first block to a second block, or a signal can be modified (e.g., amplified, attenuated, delayed, latched, buffered, inverted, filtered, or otherwise modified)

between the blocks. Although the signals of the above described embodiment are characterized as transmitted from one block to the next, other embodiments of the present systems and methods may include modified signals in place of such directly transmitted signals as long as the informational and/or functional aspect of the signal is transmitted between blocks. To some extent, a signal input at a second block can be conceptualized as a second signal derived from a first signal output from a first block due to physical limitations of the circuitry involved (e.g., there will inevitably be some attenuation and delay). Therefore, as used herein, a second signal derived from a first signal includes the first signal or any modifications to the first signal, whether due to circuit limitations or due to passage through other circuit elements which do not change the informational and/or final functional aspect of the first signal.

While the foregoing disclosure sets forth various embodiments using specific block diagrams, flowcharts, and examples, each block diagram component, flowchart step, operation, and/or component described and/or illustrated herein may be implemented, individually and/or collectively, using a wide range of hardware, software, or firmware (or any combination thereof) configurations. In addition, any disclosure of components contained within other components should be considered exemplary in nature since many other architectures can be implemented to achieve the same functionality.

The process parameters and sequence of steps described and/or illustrated herein are given by way of example only and can be varied as desired. For example, while the steps illustrated and/or described herein may be shown or discussed in a particular order, these steps do not necessarily need to be performed in the order illustrated or discussed. The various exemplary methods described and/or illustrated herein may also omit one or more of the steps described or illustrated herein or include additional steps in addition to those disclosed.

Furthermore, while various embodiments have been described and/or illustrated herein in the context of fully functional computing systems, one or more of these exemplary embodiments may be distributed as a program product in a variety of forms, regardless of the particular type of computer-readable media used to actually carry out the distribution. The embodiments disclosed herein may also be implemented using software modules that perform certain tasks. These software modules may include script, batch, or other executable files that may be stored on a computer-readable storage medium or in a computing system. In some embodiments, these software modules may configure a computing system to perform one or more of the exemplary embodiments disclosed herein.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the present systems and methods and their practical applications, to thereby enable others skilled in the art to best utilize the present systems and methods and various embodiments with various modifications as may be suited to the particular use contemplated.

Unless otherwise noted, the terms "a" or "an," as used in the specification and claims, are to be construed as meaning "at least one of." In addition, for ease of use, the words "including" and "having," as used in the specification and claims, are interchangeable with and have the same meaning as the word "comprising." In addition, the term "based on" as used in the specification and the claims is to be construed as meaning "based at least upon."

What is claimed is:

1. A method for determining a state of a door, comprising:

identifying, based at least in part on a door sensor, a first position of the door, wherein:

the door sensor is positioned at a first side of the door, and a magnet is positioned adjacent to the door sensor at the first side of the door, wherein the magnet is positioned at an angle with respect to the door sensor;

determining, based at least in part on the door sensor and the magnet, when the door changes position from the first position to a second position;

determining movement of the door, wherein the door sensor is operable to detect movement of the door through a reed switch incorporated into the door sensor, where the reed switch includes a pair of magnetizable, flexible, metal reeds with end portions that are separated by a small gap when the door is open and the reeds are together when the door is closed, whereby an electrical circuit is complete when the door is closed;

wirelessly transmitting data concerning the change in position of the door; and moving the door with a drive mechanism mounted to the door to open or close the door based at least in part on the data from the door sensor;

wherein the first side of the door comprises at least one hinge connected to a door frame.

2. The method of claim 1, wherein the door sensor is mounted on a door frame adjacent to the first side of the door and wherein the magnet is mounted on the first side of the door.

3. The method of claim 1, wherein the magnet is mounted on a door frame adjacent to the first side of the door and wherein the door sensor is mounted on the first side of the door.

4. The method of claim 1, further comprising:

determining with the motion sensor when an object moves through an opening that exists when the door is in an open position.

5. The method of claim 1, wherein the first position is a closed position, and the second position is an open position.

6. The method of claim 1, wherein the first position is a first open position, and the second position is a second open position.

7. The method of claim 1, further comprising:

determining at least one of the first and second positions.

8. The method of claim 1, wherein the angle at which the magnet is positioned is adjustable to alter a sensitivity of the door sensor.

9. A sensor assembly for use with a door, comprising:

a door sensor positioned at a first side of the door; and a magnet positioned adjacent to the door sensor at the first side of the door, wherein the magnet is positioned at an angle with respect to the door sensor;

wherein the sensor assembly is further operable to determine movement of the door, wherein the sensor assembly is operable to determine when the door changes position from a first position to a second position through a reed switch incorporated into the door sensor, where the reed switch includes a pair of magnetizable, flexible, metal reeds with end portions that are separated by a small gap when the door is open and the reeds are together when the door is closed, whereby an electrical circuit is complete when the door is closed; and a drive mechanism mounted to the door to open or close the door based at least in part on the data from the door sensor;

wherein the first side of the door comprises at least one hinge connected to a door frame.

10. The sensor assembly of claim 9, wherein the door sensor is mounted on a door frame adjacent to the first side of the door and wherein the magnet is mounted on the first side of the door.

11. The sensor assembly of claim 9, wherein the magnet is mounted on a door frame adjacent to the first side of the door and wherein the door sensor is mounted on the first side of the door.

12. The sensor assembly of claim 9, wherein the sensor assembly is further operable to determine with the motion sensor when an object moves through an opening that is controlled by the door.

13. The sensor assembly of claim 9, wherein the first position is a closed position, and the second position is an open position.

14. The sensor assembly of claim 9, wherein the first position is a first open position, and the second position is a second open position.

15. The sensor assembly of claim 9, wherein the sensor assembly is further operable to determine at least one of the first and second positions.

16. A door position detecting apparatus, comprising:

a door sensor positioned at a first side of the door;

a magnet positioned adjacent to the door sensor at the first side of the door, wherein the magnet is positioned at an angle with respect to the door sensor;

wherein the sensor assembly is further operable to determine movement of the door through a reed switch incorporated into the door sensor, where the reed switch includes a pair of magnetizable, flexible, metal reeds with end portions that are separated by a small gap when the door is open and the reeds are together when the door is closed, whereby an electrical circuit is complete when the door is closed; and a transmitter configured to wirelessly transfer data when the door changes position from a first position to a second position, based at least in part on the door sensor and the magnet;

a drive mechanism mounted to the door to open or close the door based at least in part on the data from the door sensor;

wherein the first side of the door comprises at least one hinge connected to a door frame.

* * * * *